US006443061B1

(12) United States Patent
Suzuki

(10) Patent No.: US 6,443,061 B1
(45) Date of Patent: Sep. 3, 2002

(54) MULTIWAY SWITCHING DEVICE FOR USE IN THREADING WEBS THROUGH A ROTARY PRINTING PRESS

(75) Inventor: Kunio Suzuki, Kawagawa (JP)

(73) Assignee: Kabushiki Kaisha Tokyo Kikai Seisakusho, Tokyo (JP)

( * ) Notice: Subject to any disclaimer, the term of this patent is extended or adjusted under 35 U.S.C. 154(b) by 36 days.

(21) Appl. No.: 09/722,055

(22) Filed: Nov. 27, 2000

(30) Foreign Application Priority Data

Feb. 28, 2000 (JP) ..... 2000-51731

(51) Int. Cl.[7] ..... B41F 13/03; B41F 13/02

(52) U.S. Cl. ..... 101/228; 101/219; 226/91; 226/92

(58) Field of Search ..... 101/228, 219; 226/91, 92

(56) References Cited

U.S. PATENT DOCUMENTS 4,059,211 A * 11/1977 Brizzolara ..... 226/11
4,370,927 A * 2/1983 Fischer ..... 101/228
5,400,940 A * 3/1995 Sato et al. ..... 101/228
5,809,892 A * 9/1998 Krüger et al. ..... 101/228

FOREIGN PATENT DOCUMENTS

GB 2332669 A * 6/1999 ..... B41F/13/03
JP 6-88695 11/1994
JP 2521385 5/1996

* cited by examiner

*Primary Examiner*—Daniel J. Colilla
(74) *Attorney, Agent, or Firm*—Rader, Fishman & Grauer, PLLC

(57) ABSTRACT

A disklike rotary switch is installed at a junction of four web-threading guideways in a rotary printing press, for use in switching a web, being threaded through the press preparatory to printing, from one to another of the guideways. The web-threading guideways are of radial arrangement, constantly spaced 45 degrees from one another, about the axis of rotation of the switch. The switch has defined therein two orthogonally intersecting, rectilinear switching guideways, each for intercommunicating one pair of web-threading guideways opposed to each other across the switch, and two arcuate switching guideways each for intercommunicating two of the web-threading guideways that are adjacent each other circumferentially of the switch. A single fluid-actuated cylinder is used for driving the switch between two preassigned angular positions. A tandem connection of two such cylinders is used in an alternative embodiment for driving the switch between three positions.

8 Claims, 12 Drawing Sheets

MULTIWAY SWITCHING DEVICE FOR USE IN THREADING WEBS THROUGH A ROTARY PRINTING PRESS

BACKGROUND OF THE INVENTION

This invention relates to a device for use in threading webs of paper or the like along prescribed paths through a rotary printing press preparatory to printing thereon. More particularly, the invention deals with such a device to be installed at an intersection of two or more crossing web guideways, or at a junction of four or more radially converging web guideways, for variously switching a web from one such guideway to another during web threading.

The web-fed rotary printing press has been used extensively, as for newspaper production, in which a plurality of webs of paper are fed from separate rolls into and through separate printing units, to a folding station. The paths of the webs have become more and more involved in recent years as the trend has been, and no doubt will continue to be, toward more colors and more pages. Particularly along the paths from the printing to the folding stations, numerous guide rollers and turnbars congregate, causing the webs to converge, diverge, and turn one way or the other many times.

A variety of devices have been suggested and used for threading webs, as they are paid out from their rolls at the supply stations of the press, along preselected ones of several alternative threading guideways extending along all the possible paths to be traced by the webs. The threading guideways include points where one guideway ramifies into two or more, where two or more guideways merge into one, and where two or more guideways intersect. Special threading guides of different constructions, with or without a switching function, have been used at such points to suit the specific requirements of these points.

Japanese Patent Publication No. 6-88695 indicate several such threading guides for use at intersections or junctions of threading guideways. Installed at a point of divergence of one threading guideway into three, one such threading guide has a movable switch having defined therein three separate switching guideways for communicating the one upstream guideway with a desired one of the three downstream guideways. Two fluid-actuated cylinders in tandem arrangement are coupled to the switch for linearly moving the same to any of the three different positions required for guiding the web from the upstream guideway into any of the three downstream ones.

Another threading guide according to the same Japanese patent publication is immovably mounted at an intersection of two intersecting threading guideways. The threading guide itself has defined therein two intersecting guideways in constant communication with the two threading guideways.

Still another such threading guide according to the above Japanese patent publication is intended for use at a point where three threading guideways converge into one. The converging guide has defined therein three guideways which are open to the three upstream guideways and which converge into one that is open to the downstream guideway.

In order to assess these prior art threading guides, there may be considered a set of alternative web paths defined by four guide rollers that are arranged, so to say, at the corners of a notional square or rectangle as seen in an end view. The second recited threading guide, with the two intersecting guideways, was conventionally mounted at the center of the four guide rollers, also as seen in an end view, for guiding the two possible webs to be threaded between the two diagonally opposite pairs of guide rollers, each pair consisting of one predetermined upstream and one predetermined downstream roller. Further, since webs may be threaded parallel to each other from the two upstream to the two downstream guide rollers, two divergent threading guides set forth above, each with a movable switch, had to be mounted adjacent the upstream guide rollers, and two convergent threading guides adjacent the downstream guide rollers, respectively.

Put to use in a rotary printing press equipped for automatic web threading in particular, these prior art devices cumbersomely crowded the neighborhoods of the guide rollers in question. In some instances, indeed, they necessitated the printing press itself to be redesigned and rendered larger in size, with the guide rollers spaced wider apart from each other and from any neighboring parts.

A more advanced, multiway switching device, capable of single-handedly performing all the functions of the noted three or more conventional devices, is taught by Japanese Patent No. 2,521,385. It comprises a pair of rotary switching disks having several switching guideways cut in a prescribed pattern therein for guiding the pair of lateral edges of the web being threaded. Each switching disk is to be rotatably mounted at a junction of four web-threading guideways of radial arrangement, with a constant angular spacing of ninety degrees about the axis of rotation of the disk.

The switching guideways in each disk include one rectilinear guideway extending diametrally of the disk for intercommunicating any two of the four web-threading guideways that are opposed to each other across the disk, and four arcuate guideways arranged symmetrically on both sides of the rectilinear guideway each for intercommunicating two web-threading guideways neighboring circumferentially of the disk. All the four arcuate switching guideways in the disk are slightly out of alignment with the four web-threading guideways when the single rectilinear switching guideway is positioned in alignment with either one diametrally opposed pair of web-threading guideways. However, when any two circumferentially neighboring web-threading guideways are in alignment with any one of the four arcuate switching guideways in the disk, so are the other two circumferentially neighboring web-threading guideways with one of the other three arcuate switching guideways.

An objection to this prior art multiway switching device is that each switching disk had to be swiveled different angles depending upon how the web-threading guideways are switched. Let it be supposed for example that the switching disk has been positioned with the rectilinear switching guideway in alignment with either one diametrally opposed pair of web-threading guideways. The disk will have to be turned ninety degrees from that angular position for intercommunicating the other diametrally opposed pair of web-threading guideways, and a much less angle in either direction for intercommunicating the web-threading guideways in desired circumferentially neighboring pairs.

Thus the prior art multiway switching device demanded an actuator mechanism that is capable of both revolving the disks ninety degrees and bidirectionally turning the same a much smaller angle. Such an actuator mechanism is of course far more complex and expensive in construction than if the switching disks need to be turned one fixed angle only for performing the multiple switching functions.

SUMMARY OF THE INVENTION

The present invention seeks to provide an improved multiway switching device of the general character defined, so made that it requires a switch actuating mechanism of materially simpler and less expensive construction than that of the closest prior art.

Briefly, the invention may be summarized as a multiway switching device for installation at a junction of a plurality of web-threading guideways in a rotary printing press for selectively switching a web from one to another of the guideways. The switching device comprises a rotary switch to be rotatably mounted to frame means at a junction of a plurality of web-threading guideways, which are of substantially radial arrangement about an axis of rotation of the rotary switch. The rotary switch has defined therein two intersecting switching guideways each for intercommunicating one pair of the web-threading guideways which are opposed to each other across the rotary switch, and at least one additional switching guideway for intercommunicating preselected two of the web-threading guideways which are adjacent each other peripherally of the rotary switch. Also included are switch drive means for causing angular displacement of the rotary switch relative to the frame means between a position where the two opposed pairs of web-threading guideways are intercommunicated via the two intersecting switching guideways, and at least one other position where the preselected two neighboring ones of the web-threading guideways are intercommunicated via the additional switching guideway.

Typically, the rotary switch is mounted at a junction of four web-threading guideways having a constant angular spacing of 45 degrees. For switching these four web-threading guideways, the rotary switch has two orthogonally intersecting, rectilinear switching guideways, and two arcuate switching guideways of symmetrical arrangement with respect to one of the rectilinear switching guideways. Each rectilinear switching guideways intercommunicates one pair of web-threading guideways that are opposed to each other diametrally of the rotary switch. Each arcuate switching guideways intercommunicate preselected two web-threading guideways that are adjacent each other circumferentially of the rotary switch. Thus the rotary switch may be angularly displaced by the switch drive means between a position where the two diametrally opposed pairs of web-threading guideways are intercommunicated via the two rectilinear switching guideways, and at least one other position where two preselected circumferentially neighboring pairs of web-threading guideways are separately intercommunicated via the two arcuate switching guideways.

In one preferred embodiment of the invention the rotary switch moves between two positions; that is, there is only one other position than the first recited position. In this case the rotary switch is driven forty-five degrees between the two positions. A simple fluid-actuated cylinder, preferably in combination with adjustable limit stops, suffices for such angular motion of the rotary switch.

In another preferred embodiment the rotary switch is movable to two other positions from the first recited position, the two other positions being angularly displaced forty-five degrees in two opposite directions from the first position. Thus the two arcuate switching guideways in the rotary switch may intercommunicate the four web-threading guideways in any circumferentially neighboring pairs. The switch drive means in this case may comprise a tandem connection of two fluid-actuated cylinders.

Either way, the switch drive means can be far simpler in construction than that of the prior art multiway switching device which had to swivel the switch through ninety degrees for switching from one diametrally opposed pair of web-threading guideways to another, and a much less angle for switching from two pairs of circumferentially neighboring web-threading guideways to the other two pairs of such guideways. In contrast to the prior art, according to the invention, the rotary switch is required to turn a fixed angle of forty-five degrees only, so that only one or two fluid-actuated cylinders of standard construction are needed in combination with a simple motion translating mechanism such as a lever for driving the switch.

Preferably, the switch drive means may include a pair of adjustable abutments, such as threaded fastener elements, for limiting the angular displacement of the switch. The switch will then stop in the exact positions required for accurate web switching.

Despite the simplicity of the switch drive means, moreover, the switching guideways in the rotary switch are relatively simple in the shape. The rotary switch is therefore easy and inexpensive of manufacture. Although the switching guideways have intersections, all such intersections can be made at right angles, or nearly so, thereby precluding the likelihood of the web deviating from the desired guideway while being switched.

The above and other objects, features and advantages of the invention and the manner of realizing them will become more apparent, and the invention itself will best be understood, from the following description taken together with the attached drawings showing the preferred embodiments of the invention.

DESCRIPTION OF THE PREFERRED EMBODIMENTS

General

Figure 1:
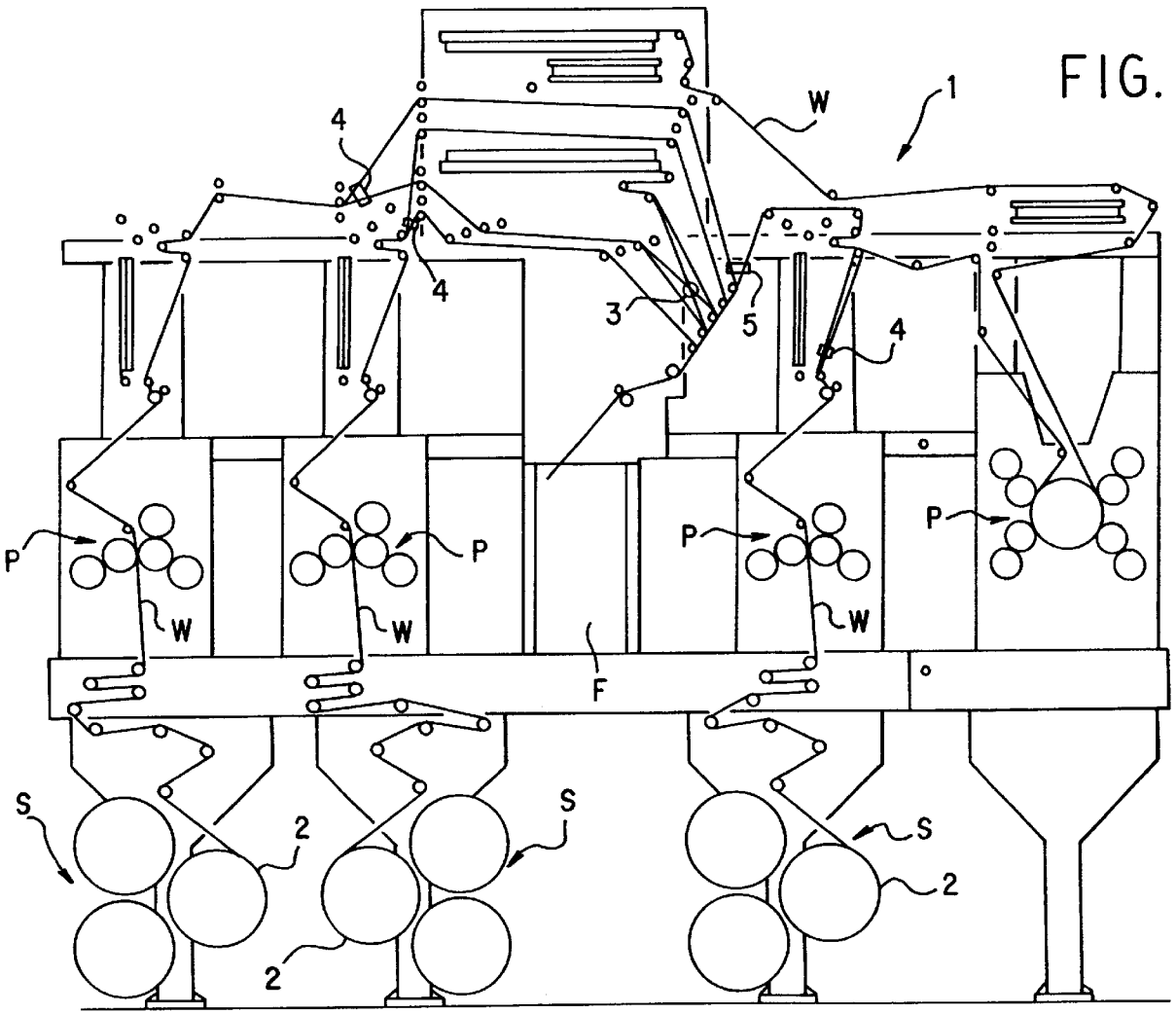
FIG. 1 is a schematic illustration of a web-fed rotary printing press to which the present invention is applied.

The present invention is believed to be best applicable to web-fed rotary printing presses such as the one pictured in FIG. 1. Generally designated 1, the exemplified printing press is shown to have three web supply stations S where webs of paper to be printed upon are held in stock in roll form. Paid out from these rolls 2, one at each supply station, the webs W are directed into respective printing stations P. The printed webs subsequently travel along the paths predefined by the guide rollers and turnbars shown, diverging, converging, intersecting, zigzagging, all the way to a folding station F situated centrally of the machine.

Figure 2:
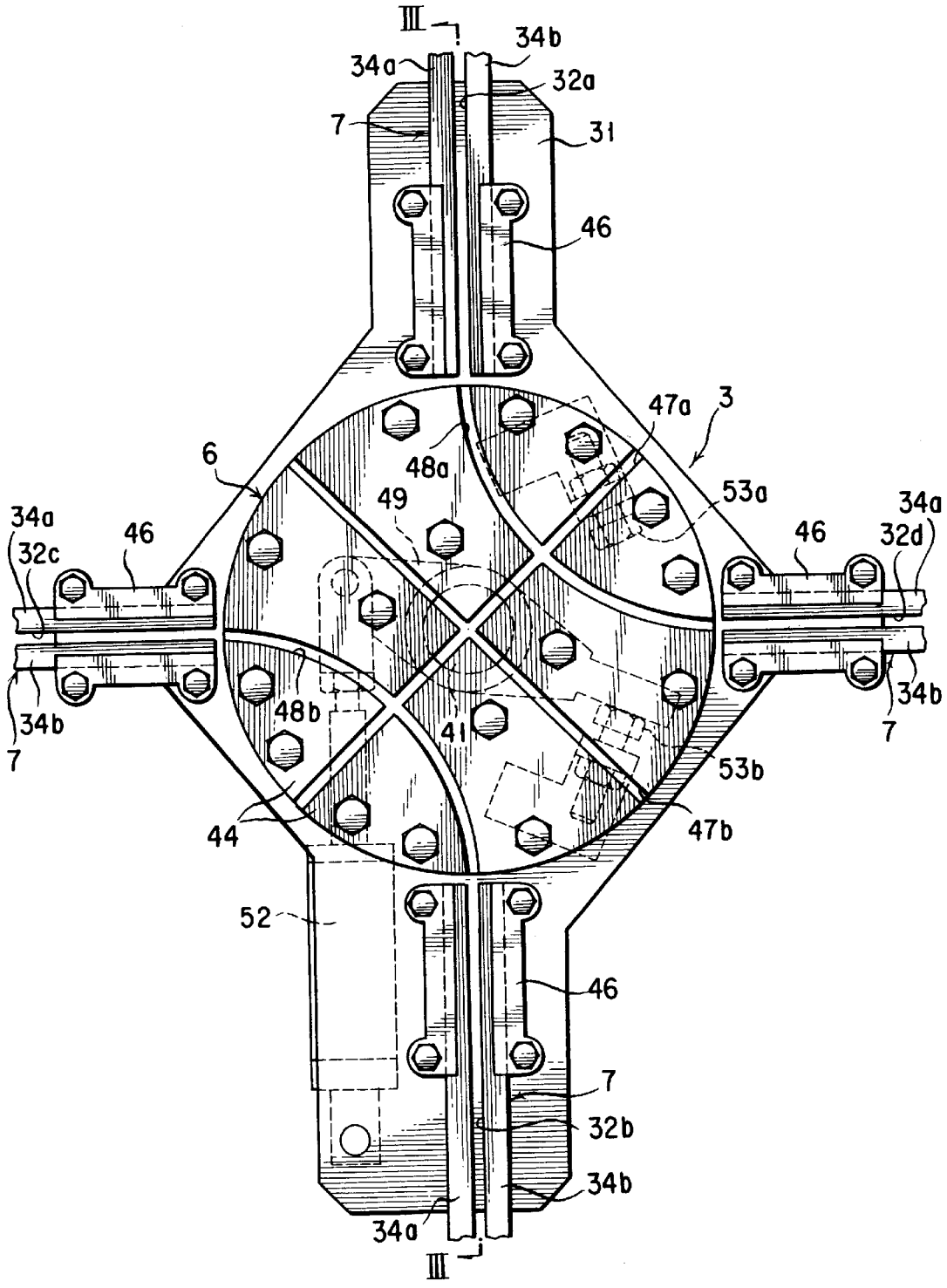
FIG. 2 is an enlarged side elevation of the multiway switching device constructed according to the novel concepts of this invention for use in the FIG. 1 printing press.

At 3 in FIG. 2 is shown a multiway switching device according to the invention, for use in guiding the lateral edges of the webs W to be threaded along alternative paths before commencement of printing operation. Incidentally, the noted divergent guides are used at 4, and the convergent guides at 5.

Figure 3:
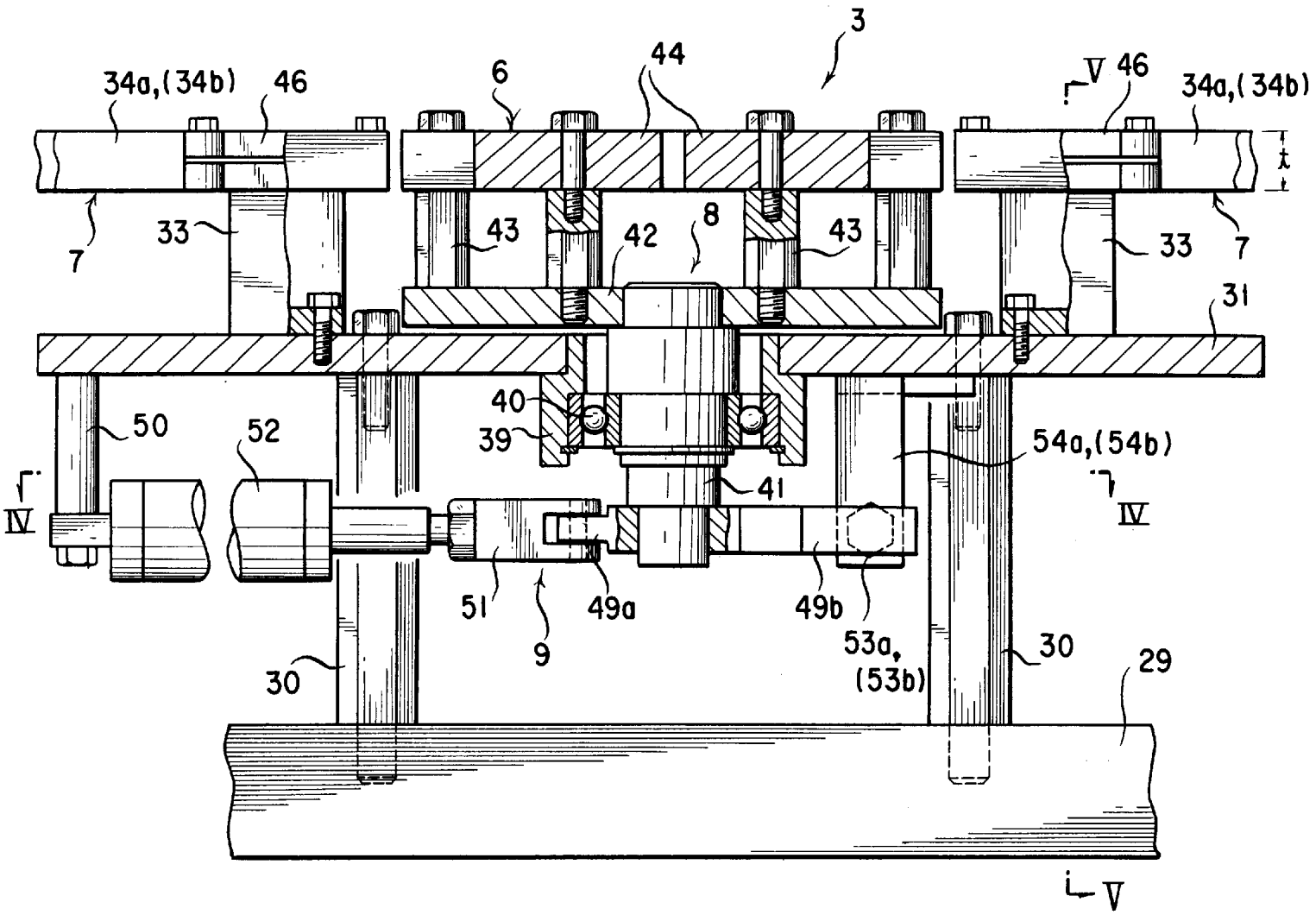
FIG. 3 is a section taken along the line III—III in FIG. 2.
Figure 4:
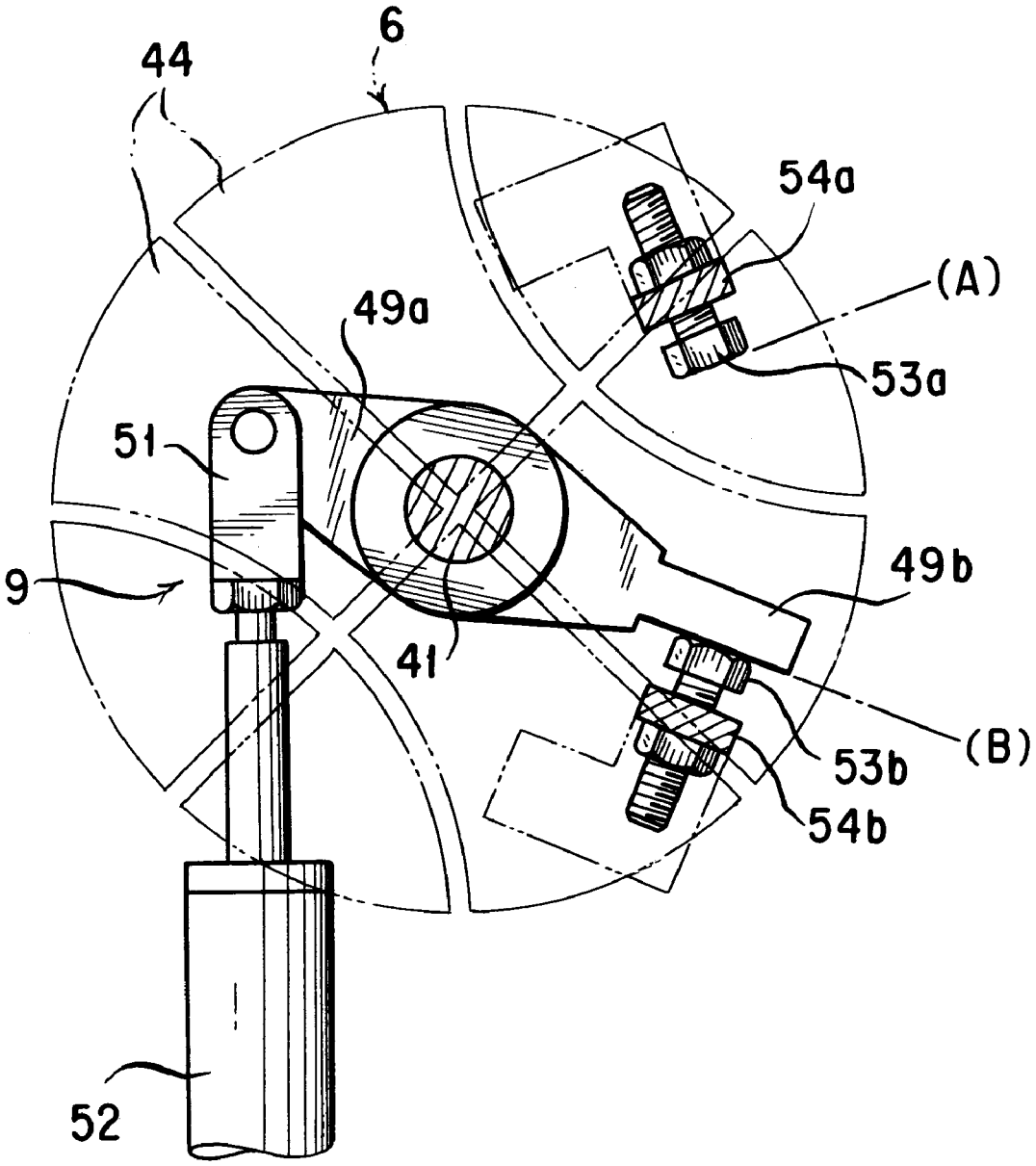
FIG. 4 is a section taken along the line IV—IV in FIG. 3.

As illustrated on a greatly enlarged scale in FIGS. 2–4, the representative multiway switching device 3 comprises: (a) a rotary switch 6, FIGS. 2 and 3, of substantially disklike shape rotatably mounted at a junction of four web-threading guide means 7 of radial arrangement defining guideways 32*a*, 32*b* 32*c* and 32*d* along which the webs W are to be threaded; (b) swivel support means 8, FIG. 3, for rotatably mounting the rotary switch to the frame means of the printing press 1; (c) and a switch drive mechanism 9, FIG. 3 and 4,for causing angular displacement of the rotary switch in order to selectively communicate the four threading guideways 32*a*–32*d*.

Hereinafter in this specification the above indicated web-threading guide means 7, rotary multiway switch 6, swivel support means 8, and switch drive mechanism 9 will be discussed in detail under separate headings. Operational description will follow the discussion of the listed components.

Web-Threading Guide Means

Figure 5:
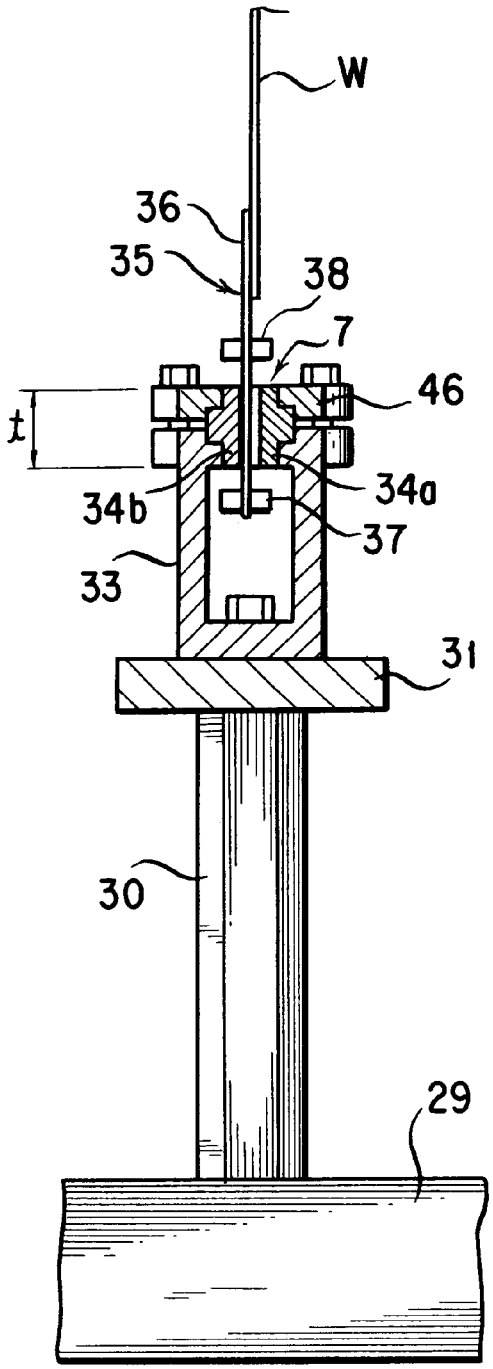
FIG. 5 is a section taken along the line V—V in FIG. 3.

The web-threading guide means 7 are formed all the way from web supply stations S to folding station F along all the possible paths to be followed by the webs W to meet the specific requirements of each specific job assigned to the printing press 1. The threading guide means 7 extend on a side wall of the machine, and the means on such side wall will be detailed with reference to FIG. 5.

At 29 in this figure is seen a fragment of one of the aforesaid pair of side walls of the printing press 1. A multiplicity of mounting brackets 30 are cantilevered to the inside surface of the side wall 29 for distally carrying a mounting plate 31 in parallel spaced relationship to the side wall 29. The web-threading guide means 7, comprised of a pair of guide rails 34*a* and 34*b*, extend parallel to the side wall 29 by being rigidly supported by series of clamps 33 of U-shaped cross section in combination with loosenable rail retainers 46, the clamps 33 being fastened to the mounting plate 31. The pair of guide rails 34*a* and 34*b* are spaced from each other in a direction normal to the plane of the web W being guided thereby. The threading guideway, designated 32*a*–32*d* in FIG. 2, thus defined between the pair of guide rails 34*a* and 34*b*, should be somewhat greater in width than the thickness of a web leader 35 yet to be described, permitting the same to run substantially unimpeded between the guide rails.

Figure 6:
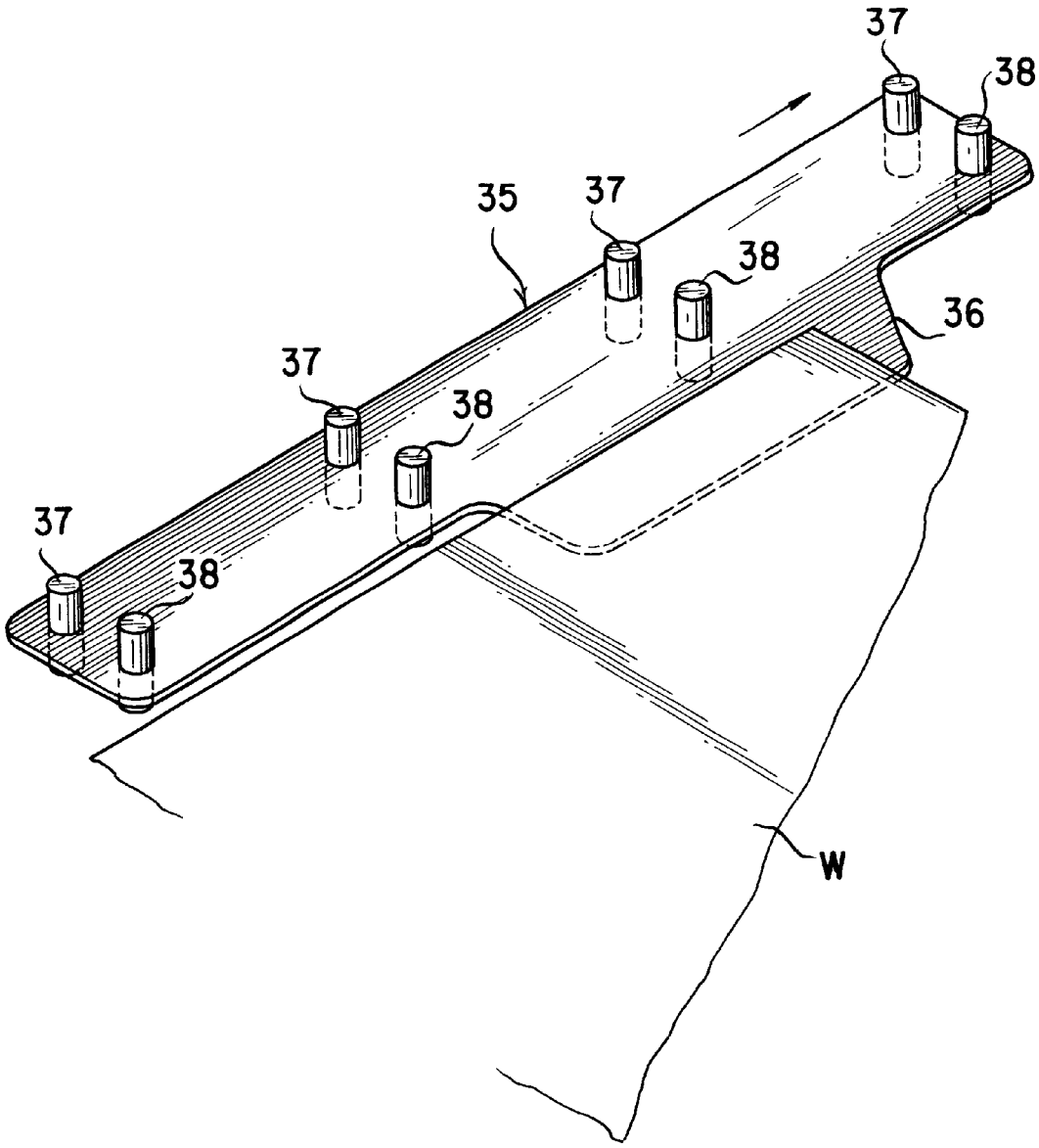
FIG. 6 is a perspective view of a web leader, shown together with a fragment of a web, for use in threading the web through the FIG. 1 printing press.

Reference may be had to FIG. 6 for a study of the web leader 35 which, in coaction with another similar one, leads the web W along the threading guideways of the foregoing make. In the form of a strip of flexible material, the web leader 35 has a tongue 36 projecting laterally therefrom. The web W at its leading end has its lateral edge portion pasted to the tongue 36 of such web leader 35. Two rows of stop pins 37 and 38, aligned longitudinally of each web leader 35, project in both directions from their opposite surfaces.

As will be understood by referring back to FIG. 5, the spacing between each transversely aligned pair of stop pins 37 and 38 on the web leader 35 is somewhat greater than the dimension t of the threading guide means 7. The stop pins 37 and 38 are themselves positioned on the outside and inside, respectively, of the guide means 7. Consequently, sliding along the guideways between the pair of guide rails 34*a* and 34*b*, the web leader 35 will be retrained from any excessive displacement in either direction laterally of the web W.

It is understood that the threading guide means 7 are conventionally equipped with series of pairs of web-driving rollers, not shown, arranged along the threading guide means at spacings less than the length of each web leader 35. A drive source, also not shown, is drivingly coupled to at least one of each pair of web-driving rollers. Frictionally engaged between the successive pairs of web-driving rollers, at least between one pair at any time, the pair of web leaders 35 are forced to run along the threading guide means 7. The multiway switching device 3 according to the invention functions to switch the web W, being so made to run automatically, from one threading guideway to another as it comes to the junction of the four such guideways 32*a*–32*d*.

Rotary Multiway Switch

The rotary multiway switch 6 will be best understood from FIGS. 2 and 3, although it appears also in FIG. 4. As has been mentioned, the switch 6 is rotatably supported at a junction of the four web-threading guideways 32*a*, 32*b* 32*c* and 32*d* of radial arrangement, each guideway being defined by the pair of guide rails 34*a* and 34*b*. Those ends of these guide rails 34*a* and 34*b* which lie opposite the switch 6 are rigidly supported by the rail retainers 46 on the mounting plate 31.

The four threading guideways 32*a*–32*d* are of constant angular spacings about the axis of rotation of the switch 6. Thus the threading guideways 32*a* and 32*b* are opposed to each other diametrally of the switch 6, and so are the other two threading guideways 32*c* and 32*d*. A web is to be threaded from one to the other of each of these diametrally opposed pairs of threading guideways, that is, from 32*a* to 32*b*, or from 32*c* to 32*d*. Further, in this particular embodiment, a web is to be threaded from either of two predetermined ones of these guideways to one neighboring circumferentially of the switch 6, that is, from 32*a* to 32*d*, or from 32*c* to 32*b*.

The switch 6 is constituted of several fragments 44 of relatively thick, rigid plate, making up in combination a generally disklike shape. The disk fragments are individually supported in the manner to be described later in connection with the swivel support means 8, for joint rotation about the axis of the disk. The disk fragments 44 are spaced from one another, defining several switching guideways configured according to the novel concepts of the invention. The switching guideways include, in this particular embodiment, two intersecting, rectilinear ones 47*a* and 47*b* each for intercommunicating either two of the threading guideways 32*a*–32*d* that are opposed to each other across the switch 6, and two arcuate ones 48*a* and 48*b* each for intercommunicating preselected two of the threading guideways that are adjacent each other circumferentially of the switch.

The two rectilinear switching guideways 47*a* and 47*b* are shown as orthogonally intersecting each other in conformity with the illustrated arrangement of the four threading guideways 32*a*–32*d* at a constant angular spacing of ninety degrees. Generally speaking, however, the two switching guideways 47*a* and 47*b* should intersect at the same angles as do the threading guideways 32*a* and 32*b* and the threading guideways 32*c* and 32*d*, so that when one rectilinear switching guideway 47*a* is brought into alignment with one diametrally opposed pair of threading guideways 32*a* and 32*b*, for instance, the other rectilinear switching guideway 47*b* is aligned with the other diametrally opposed pair of threading guideways 32*c* and 32*d*. A web is to be threaded through either of the two rectilinear switching guideways 47*a* and 47*b* when they are thus aligned with the two diametrally opposed pairs of threading guideways.

The two arcuate switching guideways 48*a* and 48*b* are arranged symmetrically on both sides of one rectilinear switching guideway, which is shown as 47*b*, and so across the other rectilinear switching guideway 47*a*. Tangents to the centerlines of the arcuate switching guideways 48*a* and 48*b* at their intersections with the rectilinear switching guideway 47*a* are at right angles with the centerline of this rectilinear switching guideway 47*a*. As the arcuate switching guideways 48*a* and 48*b* almost right-angularly cross the rectilinear switching guideway 47*a* in this manner, there will be practically no risk of the web leader 35 accidentally deviating from either arcuate switching guideway into the rectilinear switching guideway, or vice versa, while being switched.

More specifically, the arrangement of the arcuate switching guideways 48*a* and 48*b* is such that when these arcuate switching guideways have each one end thereof held opposite the two threading guideways 32*a* and 32*c* as in FIG. 2, the other ends of the arcuate switching guideways lie opposite the other two threading guideways 32*d* and 32*b*. Therefore, in this particular embodiment, the arcuate switching guideways 48*a* and 48*b* simultaneously intercommunicate the two threading guideways 32*a* and 32*d* neighboring each other circumferentially of the switch 6, and the other two similarly neighboring threading guideways 32*b* and 32*c* as in FIG. 2. A web may be threaded through either of these arcuate switching guideways 48*a* and 48*b*, or two webs may be threaded simultaneously through both of them, when they are thus aligned with the two circumferentially neighboring pairs of threading guideways.

Incidentally, given a slightly modified switch drive mechanism, the two arcuate switching guideways 48*a* and 48*b* would be brought into alignment with the other two circumferentially neighboring pairs of threading guideways 32*a* and 32*c*, and 32*b* and 32*d*. An alternative embodiment will be disclosed subsequently which incorporates such a modified switch drive mechanism in order to make such displacement of the switch 6 possible. The switching guideways 47*a*, 47*b*, 48*a* and 48*b* are formed as aforesaid throughout the thickness of the rotary switch 6, which is equal to the dimension t, FIG. 5, of the threading guide means 7. This dimension t in turn is slightly less than the spacing between the two rows of stop pins 37 and 38 on the web leader 35, FIG. 6. Therefore, carrying the web W, the web leader 35 can travel through any of the four switching guideways 47*a*, 47*b*, 48*a* and 48*b* for threading the web from one to another of the four radial threading guideways 32*a*–32*d* as above described.

Swivel Support Means

As best depicted in FIG. 3, the swivel support means 8 includes a spindle 41 rotatably mounted to the mounting plate 31 via a mounting sleeve 39 and an antifriction bearing 40. A turntable 42 is mounted fast to the spindle 41 for joint rotation therewith. The rotary switch 6, constituted of the disk fragments 44, is coaxially mounted to the turntable 42 in parallel spaced relationship thereto via a plurality of posts or spacers 43, so that the switch rotates with the turntable and hence with the spindle 41.

It will be observed from FIG. 3 that the rotary switch 6 is in coplanar relationship to the guide rails 34*a* and 34*b* defining the threading guideways 32*a*–32*d*. The web leader 35 carrying the web W is therefore movable from any of these threading guideways into any of the switching guideways 47*a*, 47*b*, 48*a* and 48*b* and back into any other of the threading guideways.

Switch Drive Mechanism

The construction of the switch drive mechanism 9 will become apparent from an inspection of FIGS. 3 and 4. It includes but one fluid-actuated cylinder 52 for swiveling the switch 6 between two preassigned angular positions in this particular embodiment. The cylinder 52 has its head end pivotally mounted at 50 on the mounting plate 31 and its rod end pivotally coupled via a clevis 51 to one end of a lever 49*a*, the other end of which is nonrotatably coupled to the spindle 41, so that this spindle rotates bidirectionally with the switch 6 with the extension and contraction of the cylinder 52. Preferably, the clevis 51 should be of adjustable length.

The lever 49*a* is formed in one piece with an arm 49*b*, which in consequence swings back and forth with the bidirectional rotation of the spindle 41. The swing arm 49*b* has its angle of swinging limited by a pair of adjustable abutments 53*a* and 53*b*, which are shown as the heads of bolts threaded into lugs 54*a* and 54*b* secured to the mounting plate 31. The stroke of the cylinder 52 is therefore determined by the angle of swinging of the swing arm 49*b* between the abutments 53*a* and 53*b*. The swinging angle of the arm 49*b* is approximately 45 degrees in the illustrated embodiment.

Operation

Let us first suppose that the cylinder 52 has been contracted until the swing arm 49*b* comes to the first angular position (A), FIG. 4, hitting the first abutment 53*a*. The resulting angular position of the rotary switch 6 is as indicated in FIG. 7, with the rectilinear switching guideway 47*a* aligned with one diametrally opposed pair of threading guideways 32*a* and 32*b*, and the other rectilinear switching guideway 47*b* aligned with the other diametrally opposed pair of threading guideways 32*c* and 32*d*.

Figure 7:
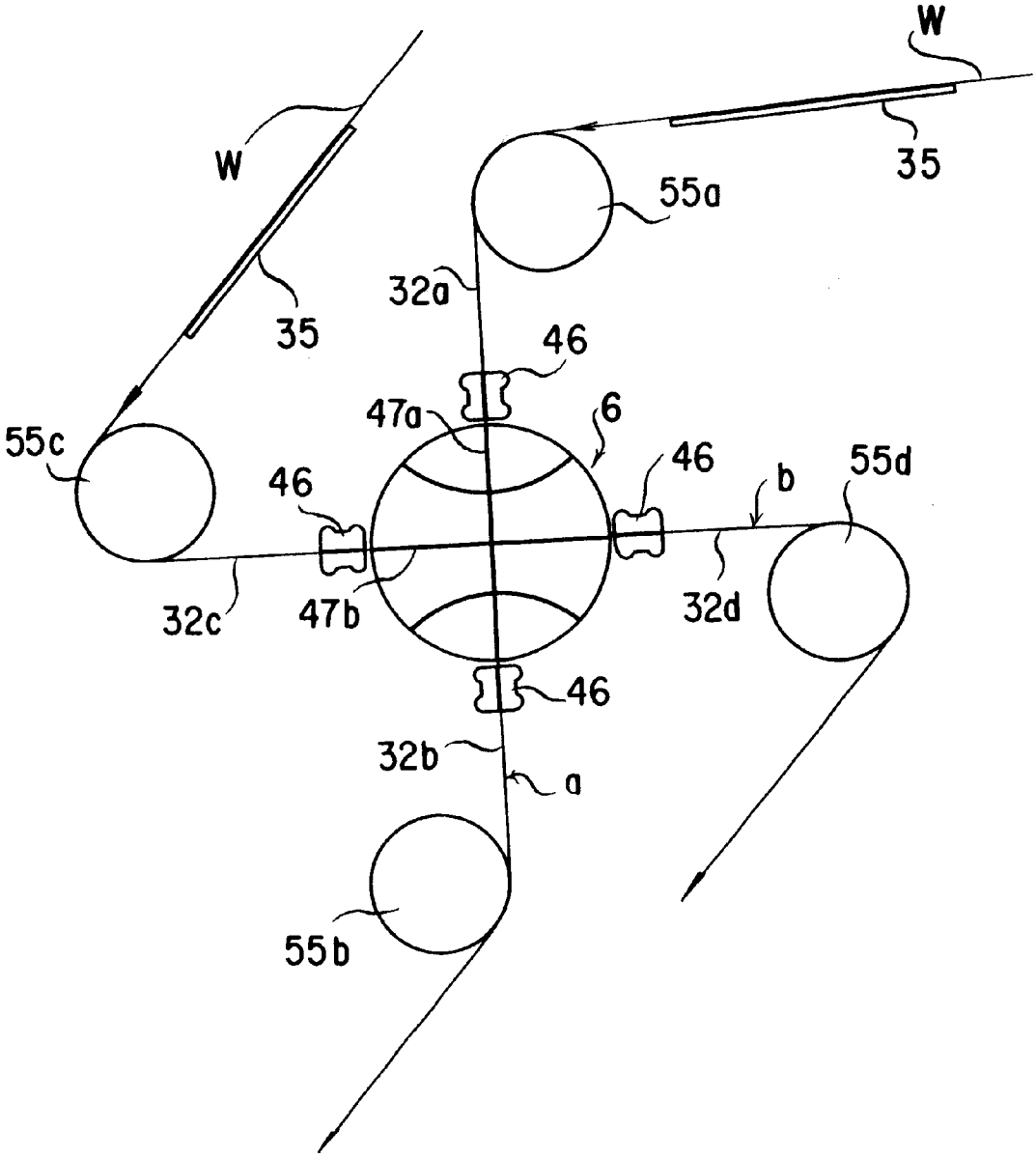
FIG. 7 is a diagram somewhat similar to FIG. 2 and explanatory of how webs are threaded when the rotary switch of the FIG. 2 switching device is positioned to intercommunicate two diametrally opposed pairs of web-threading guideways.

FIG. 7 also indicates four guide rollers 55*a*, 55*b*, 55*c* and 55*d* defining the alternative paths of the webs W to be switched by the multiway switching device 3. The guide rollers 55*a* and 55*c* are upstream, and 55*b* and 55*d* are downstream, with respect to the traveling directions of the webs W. If the web leader 35 travels from the first upstream guide roller 55*a* into the first rectilinear switching guideway 47*a*, a first web path a will be formed from first upstream guide roller 55*a* to first downstream guide roller 55*b* by way of the first threading guideway 32*a*, first rectilinear switching guideway 47*a*, and second threading guideway 32*b*.

Alternatively, if the other web leader 35 shown travels from the second upstream guide roller 55*c* into the second rectilinear switching guideway 47*b*, a second web path b will be created from that second upstream guide roller 55*c* to second downstream guide roller 55*d* by way of the third threading guideway 32*c*, second rectilinear switching guideway 47*b*, and fourth threading guideway 32*d*.

In short the web is threaded through either of the two intersecting rectilinear guideways 47*a* and 47*b* when the cylinder is contracted as in FIG. 7. It is understood that the web leader 35, traveling automatically, is incapable of right-angular turn.

Upon extension of the cylinder 52, on the other hand, the switch 6 will swivel until the swing arm 49*b* hits the second abutment 53*b* as in FIG. 4, occupying the second angular position (B). The switch 6 is now positioned as indicated in both FIGS. 2 and 8 with respect to the four threading guideways 32*a*–32*d*. The arcuate switching guideway 48*a* in the switch 6 communicates the threading guideway 32*a* with the threading guideway 32*d* neighboring circumferentially of the switch. The other arcuate switching guideway 48*b* communicates the threading guideway 32*c* with the threading guideway 32*b* neighboring circumferentially of the switch.

If now the web leader 35 travels from the first upstream guide roller 55*a* into the first arcuate switching guideway 48*a* in the switch 6, a third web path c will be created from that first upstream guide roller 55*a* to second downstream guide roller 55*d* by way of the first threading guideway 32*a*, first arcuate switching guideway 48*a*, and fourth threading guideway 32*d*.

Alternatively or concurrently, the other web leader 35 shown may be caused to travel from the second upstream guide roller 55*c* into the second arcuate switching guideway 48*b*. A fourth web path d will then be established from second upstream guide roller 55*c* to first downstream guide roller 55*b* by way of the third threading guideway 32*c*, second arcuate switching guideway 48*b*, and second threading guideway 32*b*.

Figure 8:
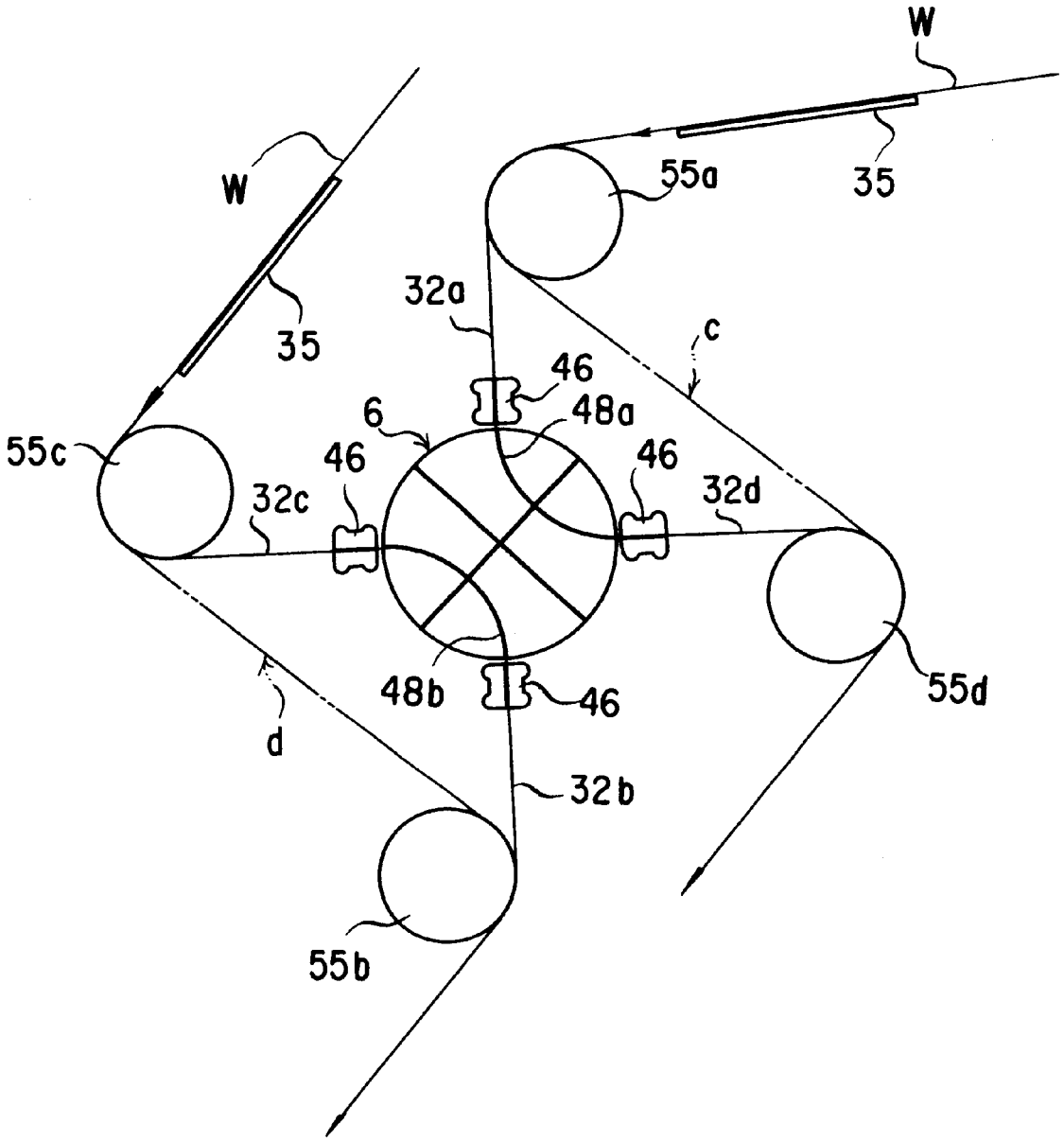
FIG. 8 is a diagram similar to FIG. 7 and explanatory of how webs are threaded when the rotary switch of the FIG. 2 switching device is positioned to intercommunicate two circumferentially neighboring pairs of web-threading guideways.

Successful functioning of the rotary switching device 3 depends to a large measure upon positioning of the rotary switch 6 with its switching guideways in exact alignment with the threading guideways as in FIG. 7 or 8. The switch 6 may therefore be made to stop exactly in the two required angular positions (A) and (B) by turning in or out the bolts constituting the abutments 53*a* and 53*b* and by adjusting the length of the clevis 51.

Second Form

Although a single fluid-actuated cylinder was used in the foregoing embodiment for turning the rotary switch between two preassigned angular positions, the switch may also be made movable to three preassigned angular positions for still more versatile switching of the four radial threading guideways. All that is required for this purpose is a slight modification of the switch drive mechanism.

Figure 9:
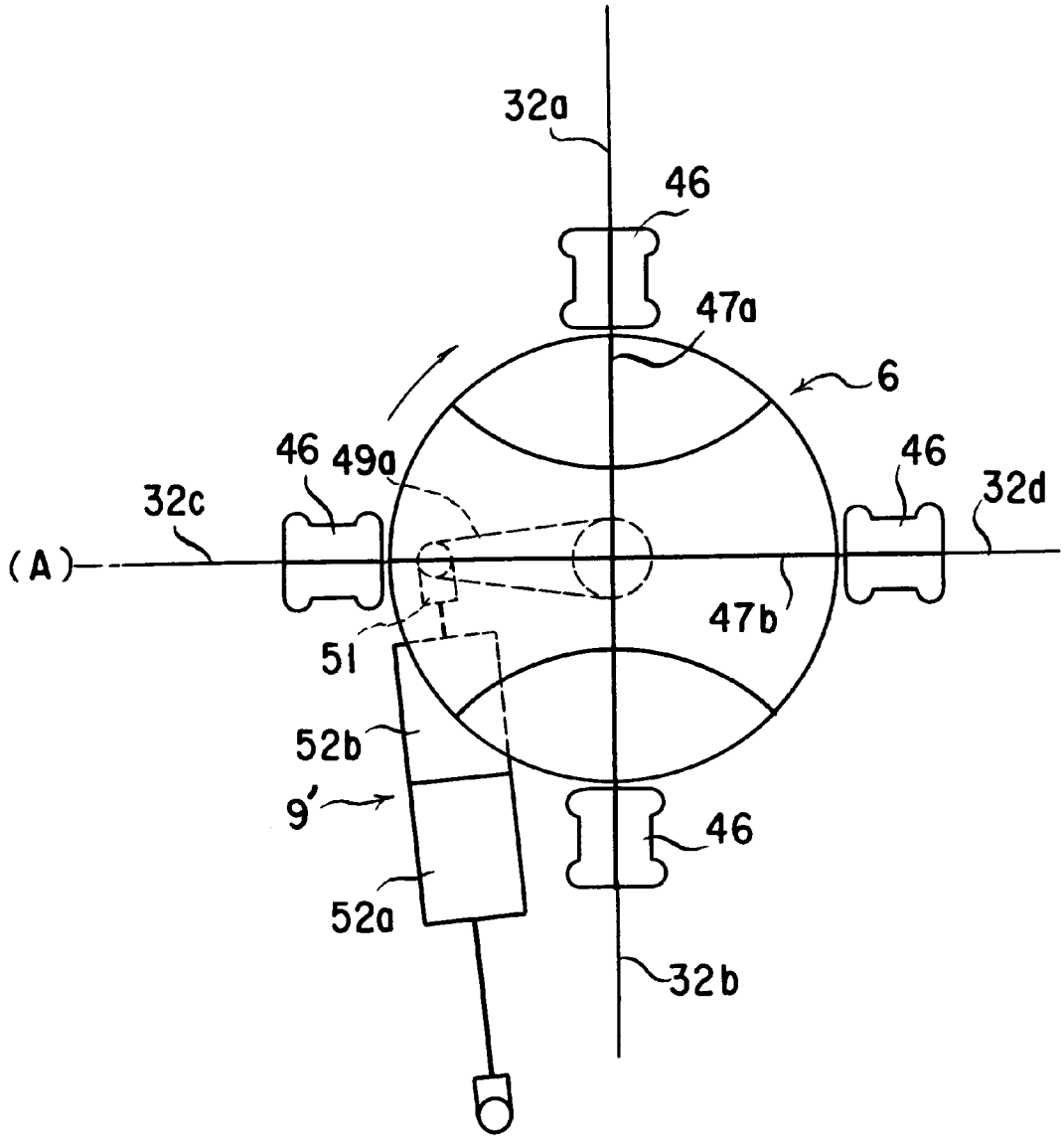
FIG. 9 is a diagram showing the rotary switch positioned to intercommunicate two diametrally opposed pairs of web-threading guideways, in a second form of multiway switching device according to the invention that employs a tandem connection of two fluid-actuated cylinders for driving the switch.

FIG. 9 indicates such a modified drive mechanism 9', which comprises two fluid-actuated cylinders 52*a* and 52*b* coupled in tandem, with their head ends held against each other. The cylinder 52*a* has its rod end pivotally coupled to a stationary part of the press whereas the other cylinder 52*b* clevis jointed to the lever 49*a*. The modified drive mechanism 9' is akin in the other details of construction to the first disclosed drive mechanism 9 shown in FIGS. 3 and 4.

Operation of Second Form

In FIG. 9 is shown the cylinder 52*a* extended, and the other cylinder 52*b* contracted. The tandem cylinder assembly is now of intermediate length, holding the rotary switch 6 in the same angular position (A) as in FIG. 7. A web is switched from the first threading guideway 32*a* to the second threading guideway 32*b* via the first rectilinear switching guideway 47*a*. Alternatively, another web may be switched from the third threading guideway 32*c* to the fourth threading guideway 32*d* via the second rectilinear switching guideway 47*b*.

Figure 10:
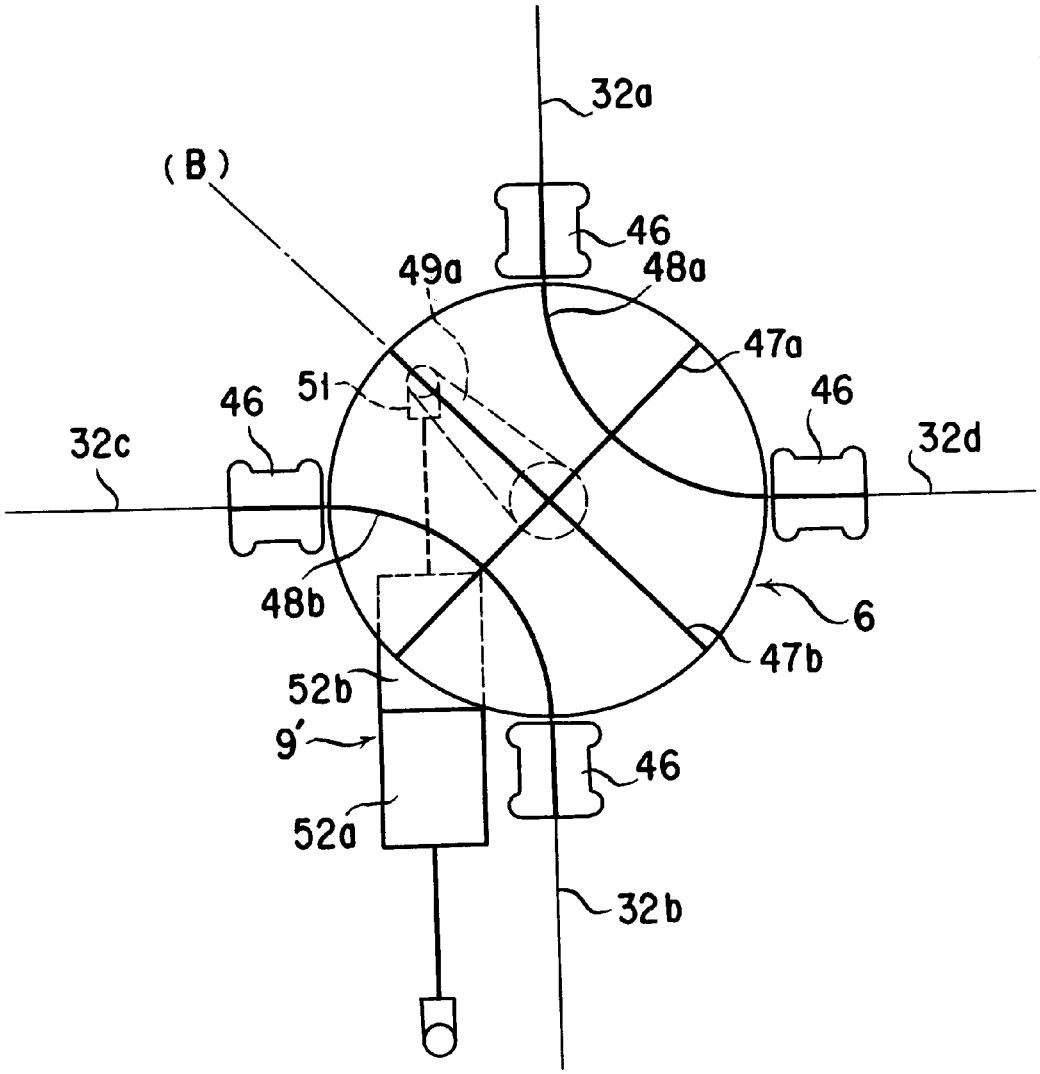
FIG. 10 is a diagram similar to FIG. 9 but showing the rotary switch swiveled 45 degrees in a clockwise direction from its FIG. 9 position to intercommunicate the web-threading guideways in two preselected circumferentially neighboring pairs.

FIG. 10 shows the tandem cylinder assembly to be of maximum length, with both cylinders 52*a* and 52*b* shown extended. The rotary switch 6 has been swiveled 45 degrees in a clockwise direction from its FIG. 9 position to that of FIG. 10, which is equivalent to the position (B) of FIG. 8. A web is switched from the first threading guideway 32*a* to the fourth threading guideway 32*d* via the first arcuate switching guideway 48*a*, and from the third threading guideway 32*c* to the second switching guideway 32*b* via the second arcuate switching guideway 48*b*.

Figure 11:
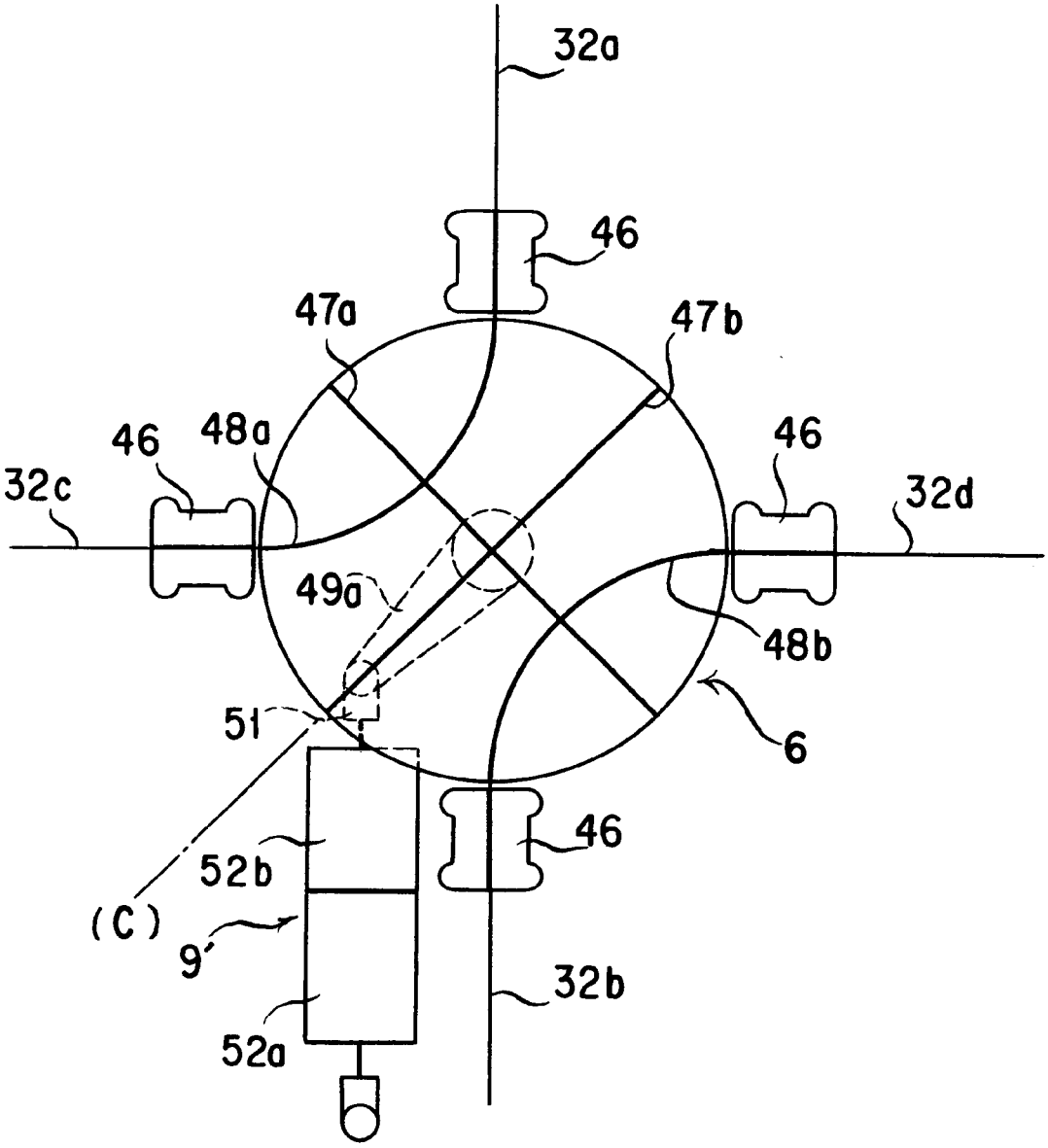
FIG. 11 is a diagram similar to FIG. 9 but showing the rotary switch swiveled 45 degrees in a counterclockwise direction from its FIG. 9 position to intercommunicate the web-threading guideways in other two preselected circumferentially neighboring pairs.

The tandem cylinder assembly is of minimum length when both cylinders 52*a* and 52*b* are contracted as in FIG. 11. The rotary switch 6 has been turned 45 degrees in a counterclockwise direction from its FIG. 9 position to that of FIG. 11, which is designated (C). This third switch position, absent from the first described switching device with the single cylinder drive mechanism, is such that the first arcuate switching guideway 48*a* intercommunicates the threading guideways 32*a* and 32*c* whereas the second arcuate switching guideway 48*b* intercommunicates the threading guideways 32*b* and 32*d*.

Figure 12:
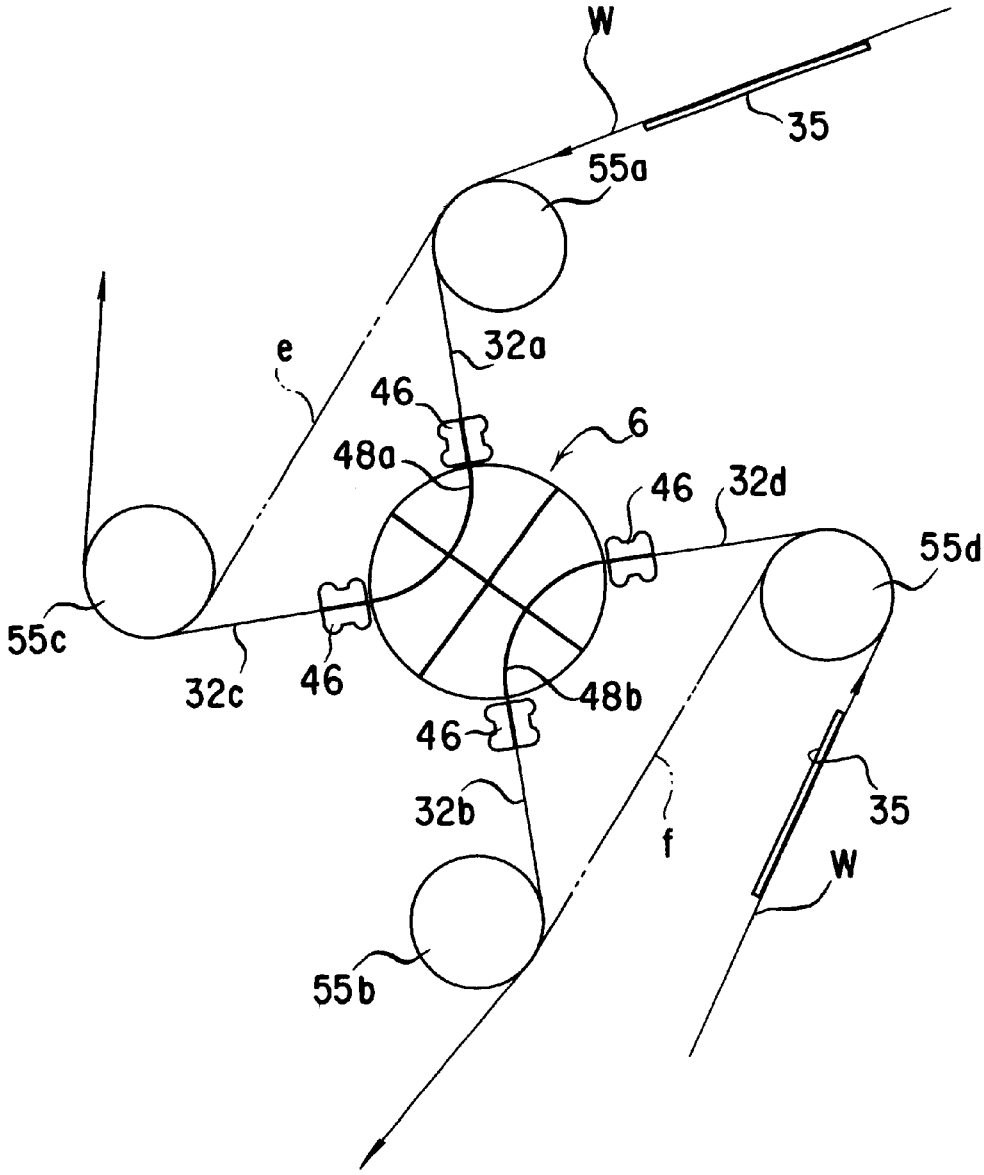
FIG. 12 is a diagram similar to FIG. 7 but explanatory of how webs are threaded when the rotary switch is positioned as in FIG. 11.

Actual web paths may be as indicated in FIG. 12 when the switch 6 is positioned as in FIG. 11. It is understood that the guide rollers 55*a* and 55*d* are upstream rollers, and the guide rollers 55*b* and 55*c* downstream rollers, in FIG. 12. A web path e will be formed as the web leader 35 travels from the first upstream guide roller 55*a* into the first arcuate switching guideway 48*a* thereby to be switched to the third threading guideway 32*c* leading to the downstream guide roller 55*c*. Another web path f will be created as the web leader 35 travels from the second upstream guide roller 55*d* into the second arcuate switching guideway 48*b* thereby to be switched to the second threading guideway 32*b* leading to the other downstream guide roller 55*b*. The travel of the webs along the guideways e and f can be concurrent, as is the travel of the webs along the FIG. 8 guideways c and d.

Since the swing arm 49*a* swings between the FIGS. 10 and 11 positions, past the FIG. 9 position, in this alternate embodiment, the two extreme positions (B) and (C) may be determined by the abutments 53*a* and 53*b*, FIG. 4. The intermediate position (A), FIG. 9, may be determined by the stroke of the drive cylinder 52*a*. Fine adjustment of the extreme positions (B) and (C) may be made by the bolts constituting the abutments 53*a* and 53*b* and in terms of the length of the clevis 51. Fine adjustment of the intermediate position (A) may be made in terms of the length of the clevis 51.

The multiway switching device according to the invention is intended for use in fully automatic web threading systems of rotary printing presses. The single cylinder 52 of the drive mechanism 9, or the tandem cylinders 52*a* and 52*b* of the alternative drive mechanism 9', may be solenoid controlled from the threading control electronic device which falls outside the purview of this invention.

Notwithstanding the foregoing detailed disclosure it is not desired that the present invention be limited by the exact showing of the drawings or the description thereof. For instance, the web-threading guideways to be switched need not be four, nor does the rotary switch need to have two rectilinear switching guideways and two arcuate switching guideways. Various modifications or alterations of the illustrated embodiments may be made to conform to design preferences or the specific requirements of each application of the invention, without departing from the scope of the invention as expressed in the claims which follow.

What is claimed is:

1. A multiway switching device to be installed at a junction of a plurality of web-threading guideways in a rotary printing press for selectively switching a web from one to another of the guideways, the switching device comprising:

(a) frame means;

(b) a rotary switch to be rotatably mounted to the frame means at a junction of a plurality of web-threading guideways, the web-threading guideways being of substantially radial arrangement about an axis of rotation of the rotary switch;

(c) there being at least two intersecting switching guideways defined in the rotary switch each for intercommunicating one pair of the web-threading guideways which are opposed to each other across the rotary switch;

(d) there being at least one additional switching guideway defined in the rotary switch for intercommunicating preselected two of the web-threading guideways which are adjacent each other peripherally of the rotary switch; and (e) switch drive means for causing angular displacement of the rotary switch relative to the frame means between a position where the two opposed pairs of web-threading guideways are intercommunicated via the two intersecting switching guideways, and at least one other position where the preselected two neighboring ones of the web-threading guideways are intercommunicated via the additional switching guideway, wherein said one other position of the rotary switch is angularly displaced a predetermined angle in a predetermined direction from the first recited position of the rotary switch, whereby the switch drive means is required to cause angular displacement of the rotary switch through the predetermined angle only and the switch drive means comprises:

(a) a spindle rotatably mounted to the frame means and rigidly carrying the rotary switch for joint rotation therewith;

(b) a linear actuator acting between the frame means and the spindle for causing angular displacement of the rotary switch through the predetermined angle;

(c) a member capable of joint angular displacement with the rotary switch; and (d) a pair of adjustable abutments mounted to the frame means in order to be abutted upon by the member for limiting the angular displacement of the rotary switch.

2. The multiway switching device of claim 1 wherein said at least one additional switching guideway in the rotary switch is of arcuate shape, crossing one of the switching guideways, and wherein a tangent to said additional switching guideway at a point of intersection thereof with said at least one switching guideway is approximately at right angles with said one switching guideway.

3. A multiway switching device to be installed at a junction of a plurality of web-threading guideways in a rotary printing press for selectively switching a web from one to another of the guideways, the switching device comprising:

(a) frame means;

(b) a rotary switch to be rotatably mounted to the frame means at a junction of a plurality of web-threading guideways, the web-threading guideways being of substantially radial arrangement about an axis of rotation of the rotary switch;

(c) there being at least two intersecting switching guideways defined in the rotary switch each for intercommunicating one pair of the web-threading guideways which are opposed to each other across the rotary switch;

(d) there being at least one additional switching guideway defined in the rotary switch for intercommunicating preselected two of the web-threading guideways which are adjacent each other peripherally of the rotary switch; and (e) switch drive means for causing angular displacement of the rotary switch relative to the frame means between a position where the two opposed pairs of web-threading guideways are intercommunicated via the two intersecting switching guideways, and at least one other position where the preselected two neighboring ones of the web-threading guideways are intercommunicated via the additional switching guideway, wherein the rotary switch is angularly displaceable from the first recited position to two other positions in each of which preselected two neighboring ones of the web-threading guideways are intercommunicated via the additional switching guideway, said two other positions being displaced a predetermined angle in two opposite directions from the first position thereof, whereby the switch drive means is required to cause angular displacement of the rotary switch through the predetermined angle only in either direction from the first position and the switch drive means comprises:

(a) a spindle rotatably mounted to the frame means and rigidly carrying the rotary switch for joint rotation therewith;

(b) two linear actuators coupled together in tandem arrangement and acting between the frame means and the spindle for causing angular displacement of the rotary switch through the predetermined angle in either of the opposite directions from the first position thereof;

(c) a member capable of joint angular displacement with the rotary switch; and (d) a pair of adjustable abutments mounted to the frame means for limiting the angular displacement of the member.

4. The multiway switching device of claim 3 wherein said at least one additional switching guideway in the rotary switch is of arcuate shape, crossing one of the switching guideways, and wherein a tangent to said additional switching guideway at a point of intersection thereof with said one switching guideway is approximately at right angles with said one switching guideway.

5. A multiway switching device to be installed at a junction of a plurality of web-threading guideways in a rotary printing press for selectively switching a web from one to another of the guideways, the switching device comprising:

(a) a rotary switch of substantially disklike shape to be rotatably mounted at a junction of four web-threading guideways, the web-threading guideways being arranged radially at constant angular spacings about an axis of rotation of the rotary switch, so that there are two pairs of such web-threading guideways which are each opposed to each other diametrally of the rotary switch;

(b) there being two intersecting, rectilinear switching guideways defined in the rotary switch each for intercommunicating one pair of web-threading guideways which are opposed to each other diametrally of the rotary switch;

(c) there being two arcuate switching guideways defined in the rotary switch each for intercommunicating two of the web-threading guideways which are adjacent each other circumferentially of the rotary switch; and (d) switch drive means for causing angular displacement of the rotary switch between a position where the two diametrally opposed pairs of web-threading guideways are intercommunicated via the two rectilinear switching guideways, and at least one other position where two preselected circumferentially neighboring pairs of web-threading guideways are separately intercommunicated via the two arcuate switching guideways, wherein said on other position of the rotary switch is angularly displaced 45 degrees in a predetermined direction from the first recited position of the rotary switch, whereby the switch drive means is required to cause 45-degree angular displacement of the rotary switch between the two positions and the switch drive means comprises:

(a) a spindle rotatably mounted to the frame means and rigidly carrying the rotary switch for joint rotation therewith;

(b) a linear actuator acting between the frame means and the spindle for causing the 45-degree angular displacement of the rotary switch between the two positions;

(c) a member capable of joint angular displacement with the rotary switch; and (d) a pair of adjustable abutments mounted to the frame means in order to be abutted upon by the member for limiting the angular displacement of the rotary switch in the two positions.

6. The multiway switching device of claim 5 wherein the two arcuate switching guideways are arranged symmetrically on both sides of one of the two intersecting rectilinear switching guideways and across the other of the rectilinear switching guideways.

7. A multiway switching device to be installed at a junction of a plurality of web-threading guideways in a rotary printing press for selectively switching a web from one to another of the guideways, the switching device comprising:

(a) a rotary switch of substantially disklike shape to be rotatably mounted at a junction of four web-threading guideways, the web-threading guideways being arranged radially at constant angular spacings about an axis of rotation of the rotary switch, so that there are two pairs of such web-threading guideways which are each opposed to each other diametrally of the rotary switch;

(b) there being two intersecting, rectilinear switching guideways defined in the rotary switch each for intercommunicating one pair of web-threading guideways which are opposed to each other diametrally of the rotary switch;

(c) there being two arcuate switching guideways defined in the rotary switch each for intercommunicating two of the web-threading guideways which are adjacent each other circumferentially of the rotary switch; and (d) switch drive means for causing angular displacement of the rotary switch between a position where the two diametrally opposed pairs of web-threading guideways are intercommunicated via the two rectilinear switching guideways, and at least one other position where two preselected circumferentially neighboring pairs of web-threading guideways are separately intercommunicated via the two arcuate switching guideways, wherein the rotary switch is angularly displaceable 45 degrees in one direction from the first recited position thereof to a second position where the two arcuate switching guideways intercommunicate the four web-threading guideways in two preselected pairs, and 45 degrees in another direction from the first position thereof to a third position where the two arcuate switching guideways intercommunicate the four web-threading guideways in two other preselected pairs, whereby the switch drive means is required to cause 45-degree angular displacement of the rotary switch in wither direction from the first position, the switch drive means comprises:

(a) a spindle rotatably mounted to frame means and rigidly carrying the rotary switch for joint rotation therewith;

(b) two linear actuators coupled together in tandem arrangement and acting between the frame means and the spindle for causing 45-degree angular displacement of the rotary switch in each of the opposite directions from the first position thereof;

(c) a member capable of joint angular displacement with the rotary switch; and (d) a pair of adjustable abutments mounted to the frame means in order to be abutted upon by the member for limiting the angular displacement of the rotary switch in the second and the third position.

8. The multiway switching device of claim 7 wherein the two arcuate switching guideways are arranged symmetrically on both sides of one of the two intersecting rectilinear switching guideways and across the other of the rectilinear switching guideways.

* * * * *